United States Patent [19]

White et al.

[11] 4,402,157

[45] * Sep. 6, 1983

[54] SHEET MATERIAL DEVICE WITH LOOSELY ROTATABLE MEMBER

[76] Inventors: David L. White; Beverly A. White, both of 7777 Mohrle, Fowlerville, Mich. 48836

[ * ] Notice: The portion of the term of this patent subsequent to Jan. 12, 1998, has been disclaimed.

[21] Appl. No.: 278,208

[22] Filed: Jun. 29, 1981

Related U.S. Application Data

[63] Continuation-in-part of Ser. No. 136,364, Apr. 1, 1980, Pat. No. 4,309,839.

[51] Int. Cl.[3] ..... A63H 3/38

[52] U.S. Cl. ..... 46/36

[58] Field of Search ..... 46/34, 36, 37, 135 R, 46/151, 157, 167, 173; 40/421, 425

[56] References Cited

U.S. PATENT DOCUMENTS

| | | | |
|---|---|---|---|
| 628,239 | 7/1899 | Cohn | 46/173 |
| 814,340 | 3/1906 | Wood | 46/157 |
| 1,679,755 | 8/1928 | Warren | 40/421 |
| 2,025,295 | 12/1935 | McCully | 46/157 |
| 2,432,318 | 12/1947 | Leech | 46/36 |
| 2,658,304 | 11/1953 | Ferrier | 46/36 |
| 3,914,897 | 10/1975 | Schoeman et al. | 46/157 X |

*Primary Examiner*—F. Barry Shay

*Attorney, Agent, or Firm*—Charles W. Chandler

[57] ABSTRACT

An amusement device, such as a doll, comprising a body formed of a relatively rigid paperboard having a plurality of circular openings, and a controlled member on the front of the body adjacent each of the openings, a handle on the rear of the body, each controlled member having a pair of spaced tabs extending through its corresponding body opening and a corresponding opening in the handle, the ends of the tabs being tapered in such a manner that as the handle is moved in a closed curved motion, each controlled member is moved in an independent, predetermined path of motion. The controlled members can take the shape of eyes or other objects on the front of the doll.

9 Claims, 5 Drawing Figures

SHEET MATERIAL DEVICE WITH LOOSELY ROTATABLE MEMBER

CROSS REFERENCE TO RELATED APPLICATION

This application is a continuation-in-part to our co-pending application Ser. No. 136,364 filed Apr. 1, 1980 and since issued Jan. 12, 1982 as U.S. Pat. No. 4,309,839.

BACKGROUND OF THE INVENTION

This invention is related to an amusement device, such as a paper doll, having a plurality of controlled members on the front side of the body of the doll, rotated by a handle mounted on the rear of the body, as the handle is being moved in a closed curved motion.

In our aforementioned co-pending application, a novel amusement device formed of a stiff cardboard was disclosed in which a plurality of independently movable members, mounted on the front of the body of the doll, are rotated by a single handle mounted on the rear of the doll so as to create an illusion of motion to the doll. Each of the movable members has a pair of tabs, connected to opposite sides of the member, which extend through a circular opening in the body and then through another similar opening in the handle. The outer ends of the two tabs are enlarged so that they cannot be accidentally withdrawn through their respective openings. A lock washer was mounted between the handle and the enlarged tab ends.

Assembly of this form of the invention requires that the tabs be inserted through a pair of slots in the lock washer.

SUMMARY OF THE INVENTION

The board purpose of the present invention is to eliminate the lock washers disclosed in the aforementioned form of the invention by providing tab ends tapered such that the handle can be manipulated to independently move each of the controlled members on the front of the doll thereby eliminating the cost of the washer, as well as the stop of assembling the washer on the doll.

Another object of the invention is to provide a controlled member having tabs received in an opening in the handle, and a pivotal section received in a slot in the body such that as the handle is manipulated, the controlled object is moved in a generally pivotal motion.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
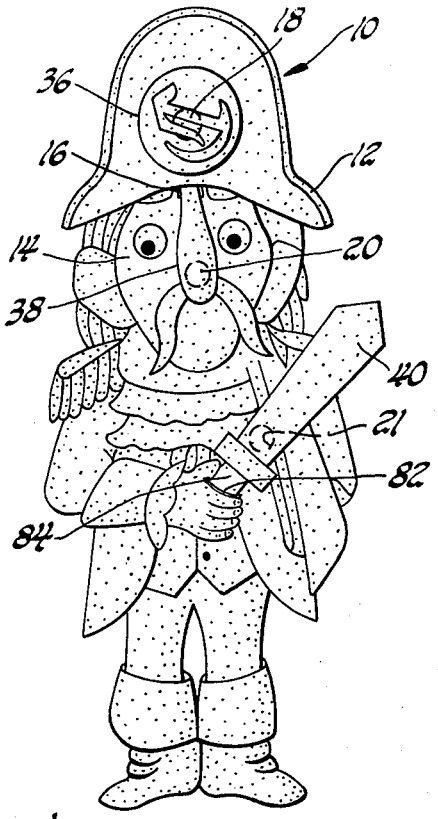
FIG. 1 is a front elevational view of a doll illustrating the preferred embodiment of the invention.
Figure 2:
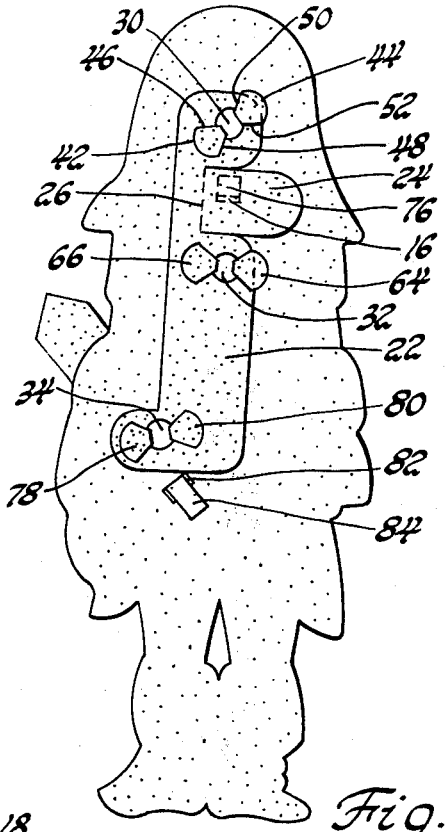
FIG. 2 is a rear view of the embodiment of FIG. 1.

FIG. 1 illustrates a preferred amusement device comprising a doll 10 having a body 12 formed of a stiff paperboard. Body 12 has a head 14 formed with a slot 16, an upper circular opening 18, and a lower circular opening 20.

The midsection of the body has a lower circular opening 21 illustrated in FIG. 1.

Figure 4:
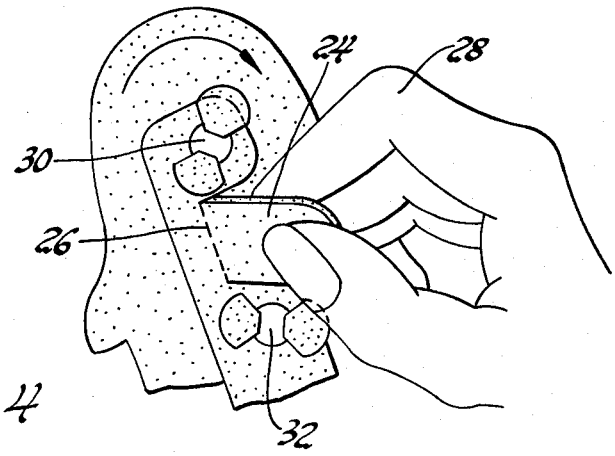
FIG. 4 illustrates the manner in which the handle is manipulated to move the components on the front of the doll.

A handle 22 is mounted adjacent the rear side of the body and also is formed of a stiff paperboard. The handle has a control tab 24, bent along a fold line 26, for user 28 to grasp, as illustrated in FIG. 4. The handle has circular openings 30, 32, and 34 disposed adjacent and rearwardly of openings 18, 20, and 21, respectively. Opening 30 is the same size as its companion opening 18, but openings 32 and 34 are smaller than their companion openings 20 and 21.

Figure 5:
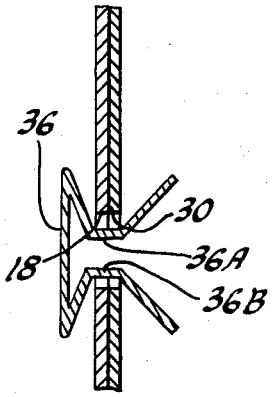
FIG. 5 is an enlarged fragmentary view of one of the movable components showing the tab structure.

An emblem 36, a nose 38, and a sword 40, which function as controlled members, are mounted on the front of the body. Referring to FIGS. 1 and 5, emblem 36 is formed of a stiff paperboard and has a circular configuration. A pair of tabs 36A and 36B are integrally connected to opposite sides of the emblem and extend through opening 18 of the body's head and opening 30 of the handle. The outer ends of the tabs are enlarged and are adapted to be folded to fit through their respective openings when being assembled.

It is to be noted that each of the tabs has substantially parallel side edges on those portions that extend through the openings in the body and the handle. The parallel side edges then become gradually larger to form tapered necks, indicated at 46, 48, 50, and 52.

Figure 3:
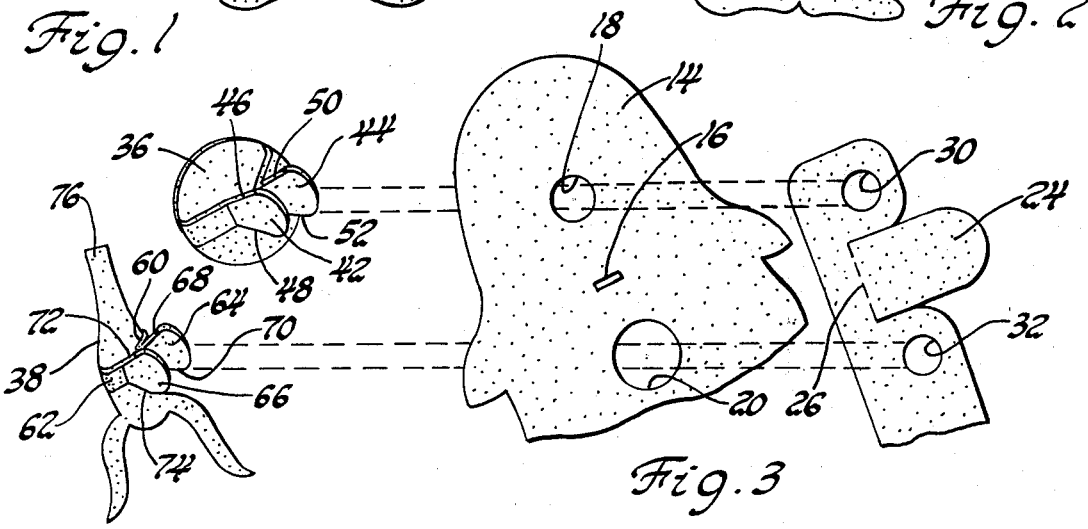
FIG. 3 is a fragmentary exploded view of a doll head.

Nose 38 also has a pair of tabs 60 and 62 which are integrally connected to opposite sides of the nose, are parallel to one another, and terminate in enlarged tab ends 64 and 66, respectively. The side edges of tabs 60 and 62 are parallel and are disposed within the openings of the body and the handle. The tabs are gradually enlarged at 68, 70, 72, and 74 and include tapered necks, as best illustrated in FIG. 3.

The upper end 76 of the nose is received in slot 16. The length of slot 16 is slightly greater than the upper end of the nose so that the lower end of the nose and the moustache can be pivoted with respect to the slot, the amount of pivotal motion being a function of the clearance between the tabs and opening 20 in the body.

Sword 40 also has a pair of tab ends 78 and 80 formed in an identical manner to tab ends 42 and 44, and 64 and 66. The body has a slot 82 for receiving sword handle 84 such that the sword can be freely pivoted.

The user assembles the device by inserting tab ends 42 and 44 of emblem 36 through openings 18 and 30 and then bending their outer ends in opposite directions. Nose 38 is assembled by first inserting the upper end of the nose into slot 16, then passing tab ends 64 and 66 through openings 20 and 32, and then bending the tab ends in opposite directions. The sword is assembled by inserting sword handle 84 through slot 82, and then passing tab ends 78 and 80 through openings 21 and 34 in the body and handle as illustrated. The outer ends of the tabs are then bent away from one another.

Because each of the enlarged ends of the tabs is larger than the opening in which it is passed, the three components cannot be accidentally removed from the body, but can be freely moved with respect to the body. The user then bends the control tab 24 about fold line 26. He then can simultaneously manipulate the emblem, sword, and nose by moving the control tab in a closed curved path behind the body, so that the three movable components give the doll a life-like motion.

The invention described in this application provides advantages over our aforementioned co-pending application because it eliminates the need for lock washers while the tapered neck of each of the tabs permits the handle to be manipulated with relative ease while rotating emblem 36 in its opening, and pivoting the sword and the nose back and forth in their respective openings.

Having described our invention, we claim:

1. An amusement device, comprising:

a body member formed of a sheet material, said body member having a front side and a rear side, and a first body opening and a second body opening, each extending between said front side and said rear side;

a handle movably disposed adjacent the rear side of the body member, the handle having an opening;

a first controlled member disposed adjacent the front side of the body member adjacent the first body opening and having a diameter larger than said first body opening, and means in said first body opening connecting the first controlled member to the handle such that the first controlled member is moved with respect to said body member as the handle is being manipulated with respect to the body member;

a second controlled member disposed adjacent the second body opening on the front side of the body, the second controlled member having a diameter larger than the second body opening;

a pair of tab means of a sheet material disposed in the second body opening so as to be rotatably movable therein, said tab means each having one end connected to the second controlled member in spaced relationship, the tab means being disposed in the handle opening and each being enlarged with a diameter larger than the handle opening such that as the handle is moved in a closed curved path of motion with respect to the body member, the second controlled member is moved with respect to said body member.

2. An amusement device as defined in claim 1, in which the second controlled member is rotated with respect to the body member as the handle is moved in said closed curved path of motion.

3. An amusement device as defined in claim 1, in which the enlarged ends of the tabs each has a tapered neck adjacent the handle opening.

4. An amusement device as defined in claim 1, in which the first controlled member moves in a reciprocating motion as the handle is moved in said closed curved path of motion.

5. An amusement device as defined in claim 1, in which the second controlled member and said tab means are integrally formed of a sheet material, the tab means extending from opposite sides of the second controlled member.

6. An amusement device as defined in claim 1, including tab means connecting the first second controlled member to the handle such that as the handle is moved in a closed circular path, the first controlled member is reciprocated with respect to said body member.

7. An amusement device as defined in claim 1, in which the first controlled member, the second controlled member, and said handle are formed of a sheet material.

8. An amusement device, comprising:

a body member formed of sheet material, said body member having a front side and a rear side, and a first opening, a second opening, and a slot extending between said front side and said rear side;

a handle having a first opening and a second opening and being disposed adjacent the rear side of said body member, and adjacent said first body opening and means connecting said handle in a loosely rotatable relationship to said body member in a location spaced from said first body opening;

a first controlled member disposed adjacent the first opening on the front side of the body, said first controlled member having a diameter larger than said first opening; and a pair of tab means disposed in said first body opening so as to be rotatably movable therein, each of said tab means having one end connected to the first controlled member and in spaced relationship with respect to one another, the opposite ends of said tab means passing through the first handle opening in a loosely rotatably relation thereto, the opposite end of each of said tab means having a tapered neck connected to an enlarged end;

a second controlled member disposed adjacent the second body opening and said slot, a portion of said second controlled member being disposed in said slot such that the second controlled member is movable with respect to the front of the body member;

a second pair of tab means of a sheet material disposed in the second body opening and the second handle opening so as to be movable therein, each of said second pair of tabs being enlarged with a diameter larger than the second handle opening.

9. An amusement device as defined in claim 8, in which the second handle opening has a smaller diameter than the first handle opening.

* * * * *